United States Patent [19]

McSwain

[11] 4,249,460

[45] Feb. 10, 1981

[54] WALL VENTILATOR CONSTRUCTION

[76] Inventor: Edward D. McSwain, Rte. 7, Box 325, Lincolnton, N.C. 28092

[21] Appl. No.: 68,949

[22] Filed: Aug. 23, 1979

[51] Int. Cl.[3] ..... F24F 7/00

[52] U.S. Cl. ..... 98/32; 98/41 R; 160/95

[58] Field of Search ..... 98/32, 37, 41 R, 41 SU, 98/42 R, 102, 106; 160/95, 103; 52/98; 16/121, 123, 171, 150

[56] References Cited

U.S. PATENT DOCUMENTS

| | | | |
|---|---|---|---|
| 304,879 | 9/1884 | Washburn | 16/123 |
| 1,198,400 | 9/1916 | Anderson | 98/37 X |
| 2,342,477 | 2/1944 | Magnehay | 16/171 |
| 2,423,317 | 7/1947 | Holton | 33/375 |
| 2,539,293 | 1/1951 | Balzer | 98/41 R X |
| 3,392,454 | 7/1968 | Haley | 33/336 |
| 3,777,649 | 12/1973 | Luckey | 98/37 |
| 4,158,902 | 6/1979 | Chernack et al. | 16/150 |
| 4,175,480 | 11/1979 | Beam, Jr. et al. | 98/37 |

FOREIGN PATENT DOCUMENTS

| | | | |
|---|---|---|---|
| 532005 | 10/1956 | Canada | 33/375 |

*Primary Examiner*—Albert J. Makay
*Assistant Examiner*—Harold Joyce
*Attorney, Agent, or Firm*—Luke J. Wilburn, Jr.; Wellington M. Manning, Jr.

[57] ABSTRACT

An improved wall ventilator for use in building constructions comprising a housing having peripheral wall members defining a ventilating passageway therethrough, a supporting lattice extending across the passageway and defining a narrow elongate slot, a manually adjustable louver section having a plurality of panels extending in side by side relation across the passageway behind the support lattice and being interconnected for pivotal movement about adjacent side edges of each other, hinge means pivotally interconnecting an end one of the plurality of panels to an adjacent side wall portion of the housing, and a manually engageable control knob attached to the opposite end one of the plurality of panels extending through the lattice slot and slideable therealong to fold and unfold the panels upon themselves about their interconnected side edges to open and close the ventilating passageway of the housing. Preferably, the housing is unitarily formed of plastic material, and the louver section is correspondingly unitarily formed of plastic material, with the panels thereof being pivotally interconnected by one or more foldable plastic webs of material unitarily formed with the panels.

12 Claims, 3 Drawing Figures

WALL VENTILATOR CONSTRUCTION

This invention relates to an improved wall ventilator construction, and, more particularly, to a manually adjustable ventilator construction which may be quickly and easily installed in a foundation wall of new or pre-existing building structures.

BACKGROUND OF THE INVENTION

It is a standard practice to provide controlled ventilation of enclosed spaces of buildings, such as crawl spaces and basements of the same, by use of ventilators located in suitable openings of the foundation enclosure walls. Such ventilators are generally provided with adjustable closure means, such as shutters or plates, to control the flow of air into and out of the enclosed space, depending upon temperature, weather conditions, and seasonal changes. Generally such foundation wall ventilators are affixed in the wall opening by cement or mortar during initial construction of the foundation wall.

Various types of ventilator constructions are known, the more common of which comprise a heavy metal rectangular frame having a metal grid, a screen across the grid, and a plate pivotally attached to the frame and movable by extension and retraction of an operating rod or lever to open and close the ventilating opening through the frame, as desired. It is also known to provide ventilator constructions having plural shutters or louvers which are pivotally movable from open to closed positions by temperature responsive springs to regulate the ventilation of foundation spaces.

More recently, it has been a practice to construct ventilators of molded plastic materials and parts to reduce the weight and/or cost of the ventilator.

OBJECTS OF THE INVENTION

It is an object of the present invention to provide an improved manually adjustable foundation ventilator which may be easily installed in foundation walls during building construction, or in openings of pre-existing foundation walls of buildings.

It is another object of the invention to provide a lightweight manually adjustable ventilator for foundation walls which is of molded plastic construction, and which is composed of only two unitarily molded sections which are readily snap-assembled together to reduce the cost of manufacture.

It is a further object to provide an improved molded plastic ventilator construction of manual operation which may be easily installed in new or pre-existing foundation walls to provide controlled ventilation of interior spaces thereof.

BRIEF DESCRIPTION OF THE DRAWINGS

The above as well as other objects of the present invention will become more apparent from the following detailed description of a preferred embodiment thereof, when taken in connection with the accompanying drawings, in which.

BRIEF DESCRIPTION OF THE INVENTION

Broadly, the present invention comprises a lightweight, economical, wall ventilator having a ventilator housing defining an air flow passageway therethrough. Located in the air flow passageway is a manually adjustable louver section comprising a plurality of panels pivotally attached to each other along their adjacent side edges and with the section pivotally attached to the ventilator housing at one side of the passageway. Manually movable means positioned on the front face of the ventilator are pivotally attached to the louver section to positionally adjust and fold and unfold the panels upon themselves to open and close the ventilating opening of the housing. Preferably, the ventilator is composed of a first unitarily formed plastic housing, and a second unitarily formed plastic louver section, which components are operatively interconnected by hinge means and louver operating means to form the ventilator.

DETAILED DESCRIPTION OF PREFERRED EMBODIMENT

Figure 1:
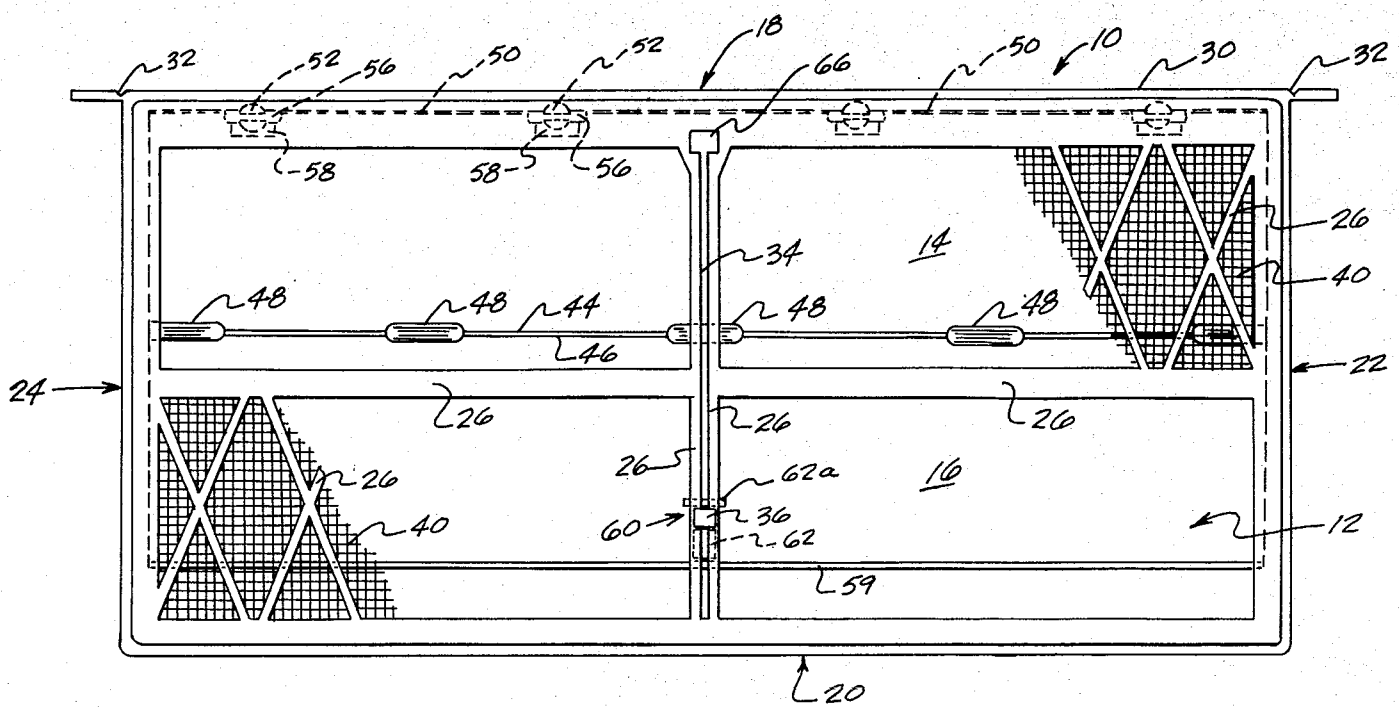
FIG. 1 is a front elevation view of the improved wall ventilator of the present invention.

Referring more particularly to the drawings, FIG. 1 is a schematic front elevation view of a preferred embodiment of the ventilator of the present invention. The foundation ventilator comprises a unitarily molded plastic housing 10 to which is attached a unitarily molded plastic louver section 12 including a pair of bifolding panels 14, 16. Housing 10 has opposed generally parallel top and bottom wall members 18, 20, and opposed side wall members 22, 24 which together form a generally rectangular ventilating passageway through the housing.

Figure 2:
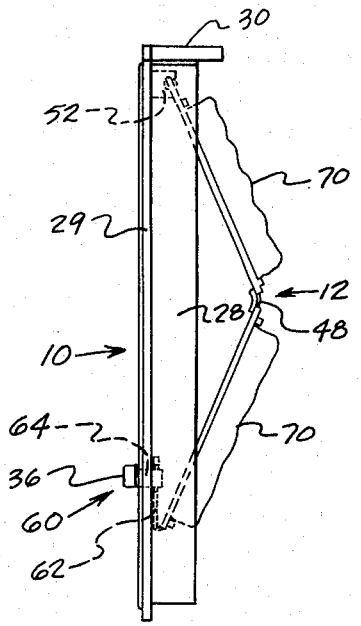
FIG. 2 is a right side elevation view of the ventilator of FIG. 1.
Figure 3:
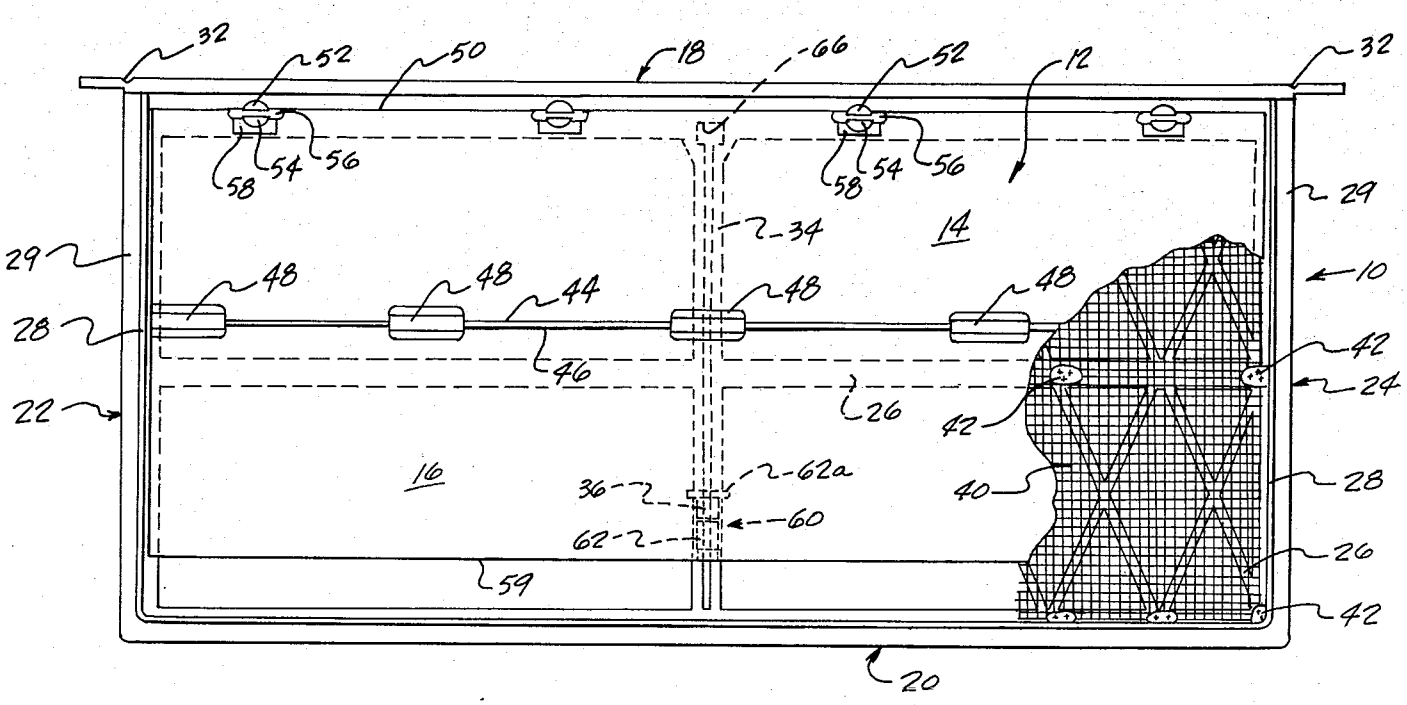
FIG. 3 is a rear elevation view of the ventilator of FIG. 1, and illustrating more clearly the manner in which the adjustable louver portion of the ventilator is attached to the housing thereof.

Unitarily formed with the wall members and extending across the ventilating passageway of the housing is a protective reinforcing lattice or grid 26 (only portions of which are shown in FIGS. 1 and 3) which lattice forms a front face or surface of housing 10. The peripheral wall members of the housing include wall portions 28 (FIGS. 2 and 3) which extend in planes parallel to the central axis of the ventilating passageway, and flange portions 29 which extned in planes perpendicular to the central axis of the passageway to overlie the periphery of a foundation wall opening in which the ventilator is to be located.

Extending across the top of housing 10 for a distance beyond each side wall member 22, 24 is a lintel 30 which facilitates support and placement of masonry materials of a foundation wall above the ventilator when the ventilator is placed in the foundation wall during initial construction. To permit installation of the ventilator in a pre-existing opening of a foundation wall, lintel 30 is molded with weakened areas or score lines 32 at the points of termination of the side wall members, such that the portions of lintel 30 which extend beyond side wall members 22, 24 may be readily broken off and the ventilator inserted into a pre-existing foundation wall opening without having to modify the masonry around the opening.

As seen in FIG. 1, the lattice or grid 26 of housing 10 defines a narrow elongate vertical slot 34 which is located centrally of the ventilating opening of the housing and extends generally perpendicularly between top wall member 18 and bottom wall member 20. Positioned within slot 34 for sliding movement therealong is a manually engageable knob 36 of a control tab of louver section 12. Knob 36 may be moved upwardly or dowwardly to open and close the ventilating passage of the housing, as will be explained. The ventilating opening of the housing is further provided with a screening material, such as a wire screen 40 (only portions of which are shown in FIGS. 1 and 3), which is positioned behind the lattice 26 of the housing and is secured to the plastic housing and lattice by heating localized portions 42 of the plastic material of the housing and lattice to melt and reharden the same about the screen 40.

As best seen in FIGS. 1 and 3, the two panels 14, 16 of molded louver section 12 extend in side by side relation across the housing passageway in a direction perpendicular to the direction of lattice slot 34. Panels 14, 16 are hingedly connected along their adjacent coextending side edges 44, 46 by a plurality of spaced plastic webs of material, or "living hinges" 48, which are formed unitarily with the panels in the molding operation. Panel 14 of louver section 12 is hingedly attached at its opposite side edge 50 to the inside surface of top wall member 18 of housing 10 by means of a plurality of spaced plastic protrusions 52 which are unitarily formed with the housing and extend rearwardly from the inside face of wall member 18. Each of the protrusions 52 is resiliently deformable and has a horizontal groove 54 therein. Edge 50 of panel 14 is provided with correspondingly spaced pivot pins 56 which span notched portions 58 in the edge of panel 14, the pivot pins and notches also being unitarily formed with the panel in the molding of louver section 12. Each protrusion groove 54 frictionally receives a corresponding pivot pin member of panel 14 in snap fit relation to provide a pivotally hinged connection of the panels to the top wall member 18 of the housing.

Formed unitarily with and extending from the lower edge 59 of louver panel 16 at a mid point along its length is an elongate louver control tab 60 which extends from the edge and has the enlarged tip portion or knob 36. As seen in FIGS. 2 and 3, tab 60 includes a vertically disposed portion 62, the lower end of which is hingedly secured by a web of thinner plastic to panel edge 59. Vertical portion 62 rides directly behind slot 34 in lattice 26 and its upper portion 62*a* is wider than the width of the slot to prevent its passage therethrough. Extending forwardly through slot 34 is a horizontal portion 64 (FIG. 2) of the tab which terminates in the enlarged control knob 36. Knob 36 of the tab is slightly larger than an enlarged opening 66 located at the upper end of lattice slot 34, and may be tapered in such a manner that the knob may be pressed through the opening 66 to the front face of lattice 26 during assembly of the ventilator, while reisting any return through the opening 66 in a rearward direction during use. As can be seen, by manually sliding knob 36 upwardly along slot 34, panels 14 and 16 pivot on hinges 48 about an axis perpendicular to the direction of slot 34 to fold upon themselves behind top wall member 18, thus fully opening the ventilator passage. Correspondingly, movement of control knob 36 downwardly to lowermost position in slot 34 pivots the panels 14, 16 to unfold the same and close the ventilator opening. If desired, the panels may also be positioned by control knob 36 to only partially open or close the ventilating passageway, as illustrated in the drawings.

From the foregoing description, it can be seen that the ventilator of the present invention may be manufactured from two unitarily molded plastic sections, housing 10 and louver section 12, and the same easily snap fit assembled to provide the manually adjustable, louvered ventilator. Although various materials may be employed in the construction of the ventilator, it has been found that a molded plastic, and in particular, polypropylene provides high strength and durability under varying weather and temperature conditions, particularly in the formation and operation of the "living hinges" which connect the bifold panels and control tab portions of the louver section 12. As shown in FIG. 2, the rear face of panels 14, 16 may also be provided with a suitable insulating material 70, such as a plastic foam, if desired.

The improved ventilator of the present invention may be incorporated into a foundation wall during initial construction of the wall, or into an opening in an existing foundation wall, and secured by conventional means, such as cement, mortar or other adhesive fastening agents.

That which is claimed is:

1. An improved wall ventilator for use in building construction comprising:

(a) a housing comprising peripheral wall means defining a ventilating passageway therethrough, and lattice means extending across said passageway from opposite wall portions and defining a narrow elongate slot across said passsageway, said slot having an enlarged portion therealong; and (b) louver means hingedly secured at one end to a wall of said housing, said louver means comprising a plurality of adjacent panels of unitary construction, adjacent panels being connected by at least one strip of like material adapted to flex along a line parallel to an axis through said panels, a panel at an end of said louver means opposite said hinge connection having a control tab of unitary construction therewith and adapted to flex at the junction between the control tab and the panel, said control tab having a knob at an outer free end of same and of unitary construction therewith, said knob being passable through said enlarged portion of said slot and slideable along the remainder of the slot while being held therein, whereby movement of said knob along said slot will cause adjacent panels to move with respect to each other around the flex line through said at least one strip of like material and said louver means to pivot about said hinge connection with said housing whereby said ventilating passageway is opened or closed.

2. A ventilator as defined in claim 1 wherein said housing and louver means are of molded polypropylene construction.

3. A ventilator as defined in claim 1 wherein said control tab means comprises an elarged knob portion having a width greater than the width of said lattice means slot to maintain said control tab means in said slot with said knob portion exposed on the face of said lattice means for manual engagement.

4. A ventilator as defined in claim 3 wherein said control tab means includes a further enlarged portion having a width greater than the width of said slot and located in spaced relation to said knob portion on the opposite side of said lattice means therefrom to facilitate retention of said knob portion on the face of said lattice means.

5. A ventilator as defined in claim 1 wherein said housing is of unitary construction and wherein said hinge means comprise a plurality of protrusions spaced along one wall of said housing, each protrusion having an elongate groove therein, and wherein corresponding pivot pin means are provided along one of said panels, said pivot pins being frictionally received within said grooves of said protrusions.

6. A ventilator as defined in claim 1 wherein said housing walls comprise opposed top, bottom and side wall members that define a generally rectangular ventilating passageway therebetween, and wherein said lattice means is attached to said wall members and extends across said passageway at one end of same to form a front face of said housing, said elongate slot extending across said passageway generally parallel to said side wall members, and wherein two panels are provided.

7. A ventilator as defined in claim 6 wherein said housing and louver means are each of unitary plastic construction, and said first hinge means comprise one or more webs of plastic material interconnecting said adjacent side edges of said panels.

8. A ventilator as defined in claim 7 including screen material supportably secured to said housing and disposed across said ventilating passage and across the rear face of said lattice means to preclude passage of foreign objects therethrough.

9. A ventilator as defined in claim 8 wherein said screen material is attached to said housing by heat melting and rehardening of localized portions of the plastic housing about said screen material.

10. An improved wall ventilator for use in building constructions comprising:

(a) a housing comprising top, bottom and side wall members defining a generally rectangular passageway therebetween, said top wall including a lintel extending beyond said side wall members, said lintel having score lines therein adjacent said side walls to permit ready removal of portions of lintel extending beyond said side walls when said ventilator is to be employed in an existing opening, and lattice means defining an elongate slot that extends generally across said passageway, parallel to said side walls; and (b) manually ajustable louver means for opening and closing said passageway comprising a single pair of moveable panels in side by side relation across said passageway between said side wall members and behind said lattice means, said panels being interconnected by first hinge means along adjacent coextending side edges with an opposite side edge portion of one of said panels being connected to said top wall member by a second hinge means, and an opposite side of said other of said panels having control tab means attached thereto and extending outwardly therefrom, through said lattice means slot of said housing, and being slideable therealong to fold and unfold said panels upon themselves about their pivotally connected side edges to open and close said ventilating passageway of the housing.

11. A ventilator as defined in claim 10 wherein said housing and said louver means are each of unitary plastic material; and said second hinge means includes one or more spaced plastic protrusions unitary with said housing and extending rearwardly from a rear face of said top wall member, each of said protrusions having a groove therein, and correspondingly spaced pivot pin means unitarily formed on said opposite side edge of said one panel and frictionally receivable in said grooves to permit pivotal movement of said one panel thereabout.

12. An improved wall ventilator comprising:

(a) a unitary molded housing, said housing comprising opposed top, bottom and side wall members defining a ventilating passageway therebetween, and a lattice means of unitary construction with said wall members and extending across said passageway, said lattice means defining an elongate slot across a portion of said passageway generally parallel to said side walls, said slot having an enlarged slot portion adjacent one end of same; and (b) manually adjustable molded louver means hingedly attached to said top wall and received behind said lattice means to open and close said ventilating passageway, said louver means comprising a pair of panels, said panels being connected by a hinge means of unitary construction therewith, said panels being foldable about said unitary hinge means, an end of a panel opposite said hinge connection to said top wall having control tab means of unitary construction therewith and extending outwardly therefrom, terminating in an enlarged knob, said control tab means being capable of flexing at the juncture with said panel to which it is connected, said knob being passable through said enlarged slot portion and being slideable along the remainder of said slot on a side of said lattice means opposite said panels to open and close said ventilating passageway.

* * * * *

UNITED STATES PATENT AND TRADEMARK OFFICE

CERTIFICATE OF CORRECTION

PATENT NO. : 4,249,460

DATED : February 10, 1981

INVENTOR(S) : Edward D. McSwain

It is certified that error appears in the above-identified patent and that said Letters Patent are hereby corrected as shown below:

Column 3, lines 1 and 2, "dowwardly" should read--downwardly--.

Column 3, line 52, "reisting" should read--resisting--.

Column 4, claim 3, line 53, "elarged" should read--enlarged--.

Signed and Sealed this

*Twenty-first* Day of *April 1981*

[SEAL]

*Attest:*

RENE D. TEGTMEYER

*Attesting Officer*

*Acting Commissioner of Patents and Trademarks*